United States Patent [19]

Morris

[11] Patent Number: 4,505,059

[45] **Date of Patent: * Mar. 19, 1985**

[54] ADVERTISING DISPLAY APPARATUS

[76] Inventor: Stanley Morris, 13 Woodside Rd., Springfield, N.J. 07079

[ * ] Notice: The portion of the term of this patent subsequent to Feb. 21, 2001 has been disclaimed.

[21] Appl. No.: 526,625

[22] Filed: Aug. 26, 1983

Related U.S. Application Data

[63] Continuation-in-part of Ser. No. 403,575, Jul. 30, 1982, Pat. No. 4,432,151.

[51] Int. Cl.[3] ..... G09F 3/18

[52] U.S. Cl. ..... 40/10 D; 211/78; 211/131; 40/493; 206/45.34

[58] Field of Search ..... 40/152.1, 505, 10 D, 40/358, 324, 493; 206/45.34; 220/23.86; 211/131, 78

[56] References Cited

U.S. PATENT DOCUMENTS

| | | | |
|---|---|---|---|
| 3,105,315 | 10/1963 | Snethen | 40/554 |
| 3,577,666 | 4/1971 | Wexler | 206/45.34 |
| 4,432,151 | 2/1984 | Morris | 40/10 D |

*Primary Examiner*—Gene Mancene

*Assistant Examiner*—Cary E. Stone

*Attorney, Agent, or Firm*—McCoy & Morris

[57] ABSTRACT

An advertising display apparatus comprising a base, means on the base for holding condiments, a plurality of support members on the base, each facing in a different respective direction, means for mounting at least one advertisement on each support member, means mounting the support members for movement relative to the base to change the direction in which a given advertisement faces.

A hollow, transparent tube having a plurality of walls constitutes transparent cover means for enclosing and protectively covering the support members. Each support member and its respective advertisement faces a respective wall on the tube. A resilient, strip-like member is located within the tube and is resiliently deformable between an expanded, open first condition and a second condition in which it is at least partially closed for urging the advertisement toward its respective wall on the tube. The apparatus is preferably displayed on restaurant tables so that customers can view the advertisements during their meal.

The tube is of a size which preferably accommodates twelve business cards; three cards per support member.

14 Claims, 3 Drawing Figures

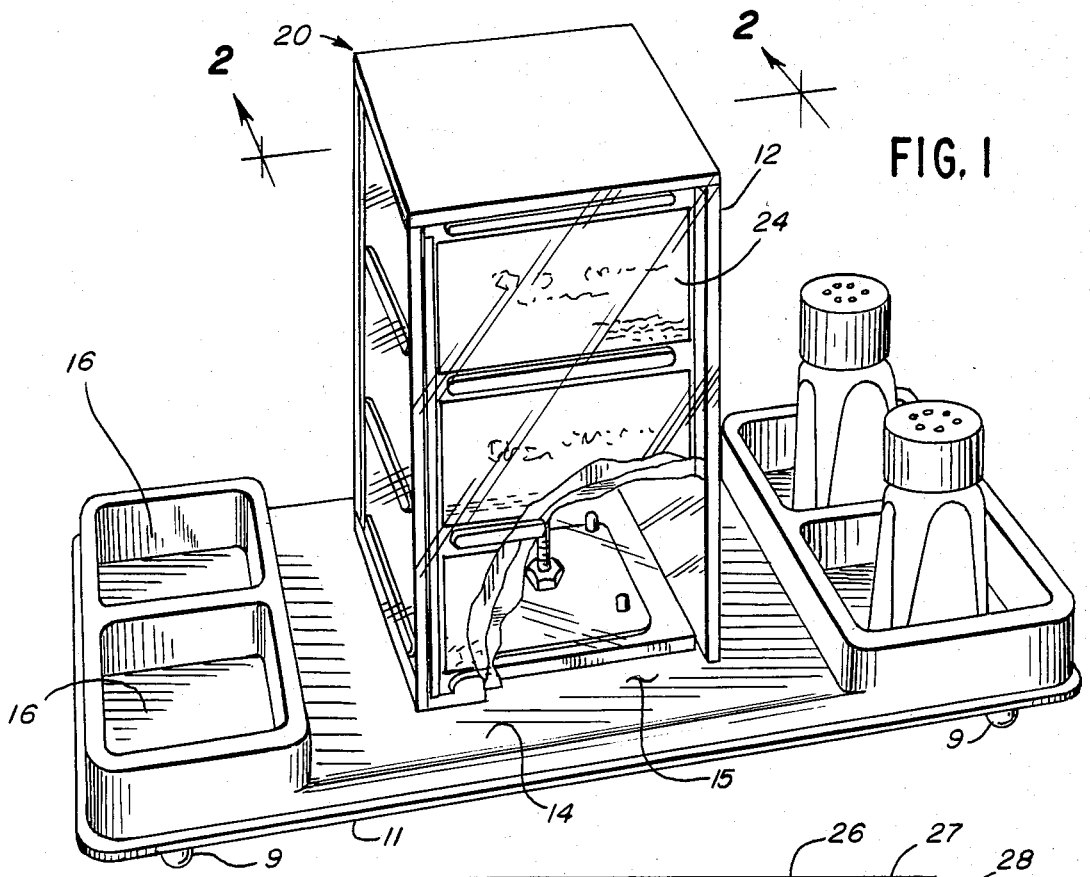
FIG. 1
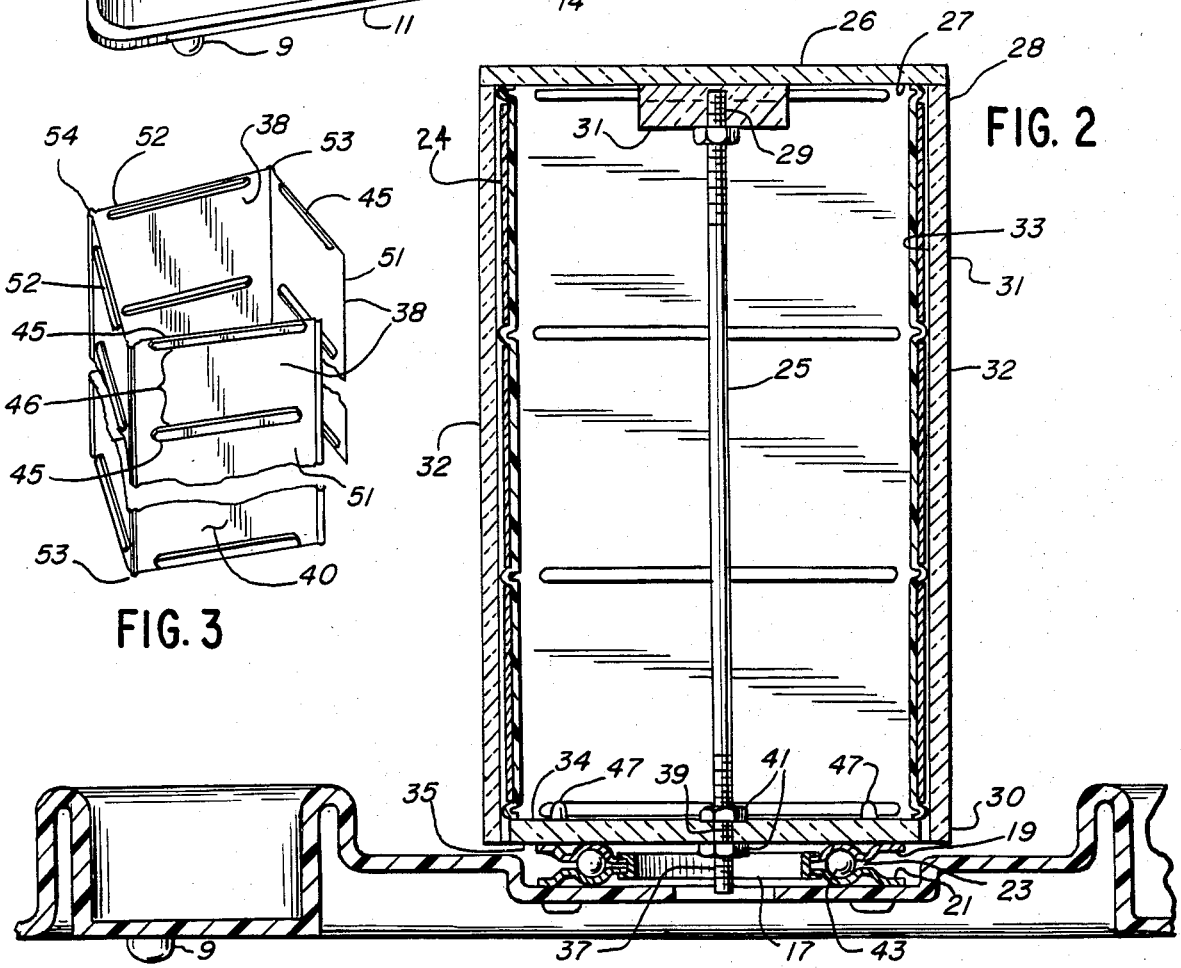
FIG. 2
FIG. 3

ADVERTISING DISPLAY APPARATUS

This is a continuation-in-part of application Ser. No. 403,575, filed July 30, 1982, now U.S. Pat. No. 4,432,151.

BACKGROUND OF THE INVENTION

1. Field of the Invention

The apparatus of the subject invention pertains to an advertising display device with a plurality of advertisements facing in different respective directions. The apparatus is preferably used on restaurant tables, so that the advertisements or menus can be viewed by customers during their meal.

2. Description of the Prior Art

Restaurant customers are a "captive" audience for most types of advertisement media while they wait for and eat their food. It is not unusual to find on restaurant tables paper displays for soft drinks and the like, and even placemats containing information to read or puzzles to solve.

Nowhere has there been provided in restaurants an advertising display apparatus which compactly advertises the services and products of a plurality of businesses on each table. If such a devise were available, the "captive" audience would become a hugh market for products and services. Obviously, restaurant owners as well as the advertisers could greatly benefit from the use of such an apparatus.

SUMMARY OF THE INVENTION

An advertising display apparatus comprising a base, means on the base for holding condiments, a plurality of support members on the base, each facing in a different respective direction, means for mounting at least one advertisement on each support member, means mounting the support members for movement relative to the base to change the direction in which a given advertisement faces.

A hollow, transparent tube having a plurality of walls constitutes transparent cover means for enclosing and protectively covering the support members. Each support member and its respective advertisement faces a respective wall on the tube. A resilient, strip-like member is located within the tube and is resiliently deformable between an expanded, open first condition and a second condition in which it is at least partially closed for urging the advertisement toward its respective wall on the tube.

The apparatus of the subject invention may be used without the base condiment holding means. In the preferred embodiment of the apparatus, each support member comprises three to four display sections. Each display section holds one business card. Thus, the apparatus is capable of simultaneously displaying twelve to sixteen business cards. Any number of cards is theoretically possible to use with each support member; however, it is desirable to use no less than two cards, and no more than four cards for each support member. In addition, a single card, advertisement of menu could be attached to a support member.

The size of the base is approximately $12\frac{1}{2}''$ long by $6\frac{3}{8}''$ wide. The size of the tube is approximately 4" square by $6\frac{7}{8}''$ high, using three cards per support member. The apparatus is reusable, lightweight, easy to clean, simple in design, and economical to manufacture.

These and other advantages of the invention will become apparent to those of ordinary skill in the art with reference to the further detailed description of this invention.

DESCRIPTION OF THE DRAWING

FIG. 1 is a perspective view of the vertically disposed tube embodiment of the advertising display apparatus;

FIG. 2 is an elevational, partial sectional view along Line 2—2 of FIG. 1; and, FIG. 3 is a partial perspective view of the resilient striplike means which comprises four hingedly connected support panels.

DESCRIPTION OF THE PREFERRED EMBODIMENT

Referring to FIG. 1, there is shown a perspective view of the preferred embodiment of the advertising display apparatus. The apparatus comprises a substantially flat, rectangularly shaped base 14 having a top surface 15. Base 14 also comprises a plurality of condiment holding means or sections 16 which are separated from each other on either end of said base by advertising display means 20. Condiment holding means 16 can hold sugar, salt, pepper and the like. Obviously, any number of condiment holding sections can be provided on the base depending upon the size of the base. Four short legs 9 may be attached to bottom surface 11 of base 14; however, the use of the legs are optional.

Advertising display means 20 comprises means for displaying a plurality of advertisements, such as business cards 24, menus (not shown) and the like. Advertising display means 20 further comprises a single integral transparent cover means which encloses and protects the business cards. Cover means comprises a hollow, vertically disposed tube 12 having a plurality of walls and having a rectangular horizontal cross-section. Tube 12 comprises a top end 28, a bottom end 30, a top piece 26 having a bottom surface 27, a bottom piece 34 having a bottom surface 35, and four (4) side pieces 32. Top piece 26 and side pieces 32 form a solid integral unit. Top piece 26 is permanently attached to tube 12. Each side piece 32 comprises an outer surface 31 and an inner surface 33. Bottom piece 34 is permanently attached with rivots 47 to a metal "lazy susan" device 17. A long threaded rod 25 is permanently attached at one end to the bottom surface 27 of top piece 26 by threading and gluing rod end 29 into a small plastic block 31 which i glued to the bottom surface 27.

A plurality of support members, or panels 38, are each hingedly connected to at least one other panel, there being a panel for each wall on the tube and each panel faces in a different respective direction. The panels comprise means for displaying a plurality of advertisements. Each panel 38 is vertically disposed contiguous to a respective inside wall 33 of a side piece 32. Each panel 38 faces a different respective direction when in place in tube 12. Each panel 38 has an outside surface 40. The outside surface 40 faces the inside wall 33 of a respective side piece 32. Each panel comprises means for mounting at least one advertisement and comprises a plurality of display sections 46. The display sections are formed by a plurality of ridges 45 which comprise means for displaying an advertisement facing in the same direction. Thus, a standard sized business card can fit between any two ridges. The cards may be removed and replaced with other cards without removing the remaining cards. The cards are removably mounted to each section 46 with "artist's" glue.

The plurality of support members or panels 38 are incorporated or integrated into a strip-like means or member for urging the advertisement on each support member toward its respective wall on the tube. The sheet of rigid, but resiliently deformable plastic is deformable between an open first condition and a second condition in which the strip is at least partially closed, when it is placed inside the tube cavity. The strip-like member comprises at least one inside panel 52 and a pair of end panels 51, each end panel having an unconnected outer edge and an inner edge connected to an inside panel. End panels 51 are joined to inside panels 52 at edges 53. Inside panels 52 are joined at edge 54. The expansion of the strip when it is within the tube is due to the inherent expanding force in the panels when the edges 53 and 54 are made by bending a straight strip at edges 53 and 54. This expanding force simultaneously pushes, or urges each panel, in an outwardly direction against the inside surface 33 of each wall 32. Thus, when panels 38 are mounted in the tube, they stay in a fixed position against their respective side walls until they are removed through the bottom end 30 of tube 12 for movement relative to the base to change the direction in which a given advertisement faces, and they comform substantially to the shape of the tube when it is in the second condition. The outer edge of end panels 51 are substantially adjacent to each other when the strip-like member is in its second partially closed position. After the panels are placed in tube 12, the tube is placed over and adjacent to bottom piece 34 and rod end 37 is placed through hole 39 in the center of the bottom piece 34. Two nuts 41 are then used to secure the tube to bottom piece 34. The purpose of this design is to make the tube relatively tamper-proof.

Tube 12 is rotatably mounted to top surface 15 of base 14 so that the direction in which a given card faces may be easily changed. Mounting tube 12 to base 14 is accomplished by using a "lazy susan" device 17 which comprises an upper and lower piece of galvanized steel 19 and 21, respectively, which form a hollow tube 23 of a size adapted to permit a plurality of steel ball bearings 43 to freely rotate therein. Upper piece 19 is bolted to bottom surface 35 of bottom end 34, and the lower piece 21 is bolted to top surface 15 of base 14. Tube 12 is free to rotate about base 14 with a minimum of friction so that each side of tube 12 may be easily viewed at any desired position by the customer.

The strip-like panel or member is approximately $14\frac{1}{2}''$ long by $6\frac{5}{8}''$ wide and is made out of rigid plastic to ensure durability. Each panel is approximately $3\frac{5}{8}''$ wide and each section is approximately $2\frac{1}{8}'' \times 3\frac{5}{8}''$. Cardboard may be used in place of the plastic support members, however, in such a case each advertisement should be permanently glued thereto. If an advertiser wishes to use two or more support sections this can be easily accomplished by deleting one more support ridges 46 from a support member 38.

The apparatus is preferably constructed out of a plastic material Lucite TM. It may be assembled by gluing the individual pieces together, or it may be molded by conventional molding techniques into a one piece base and/or a one piece tube.

In the preferred embodiment of the apparatus, twelve cards are displayed at one time. Obviously, a longer tube 12 may be used to accommodate more cards; however, a four "tier" tube is the maximum desirable height and a two "tier" tube is the minimum desirable height.

Referring to FIG. 1, the size of base 14 is approximately $12\frac{1}{2}''$ long by $6\frac{3}{8}''$ wide although the use of condiment holding sections is optional, which would then shorten the length of the base. Additionally, the size of tube 12 is approximately 4" square by $6\frac{7}{8}''$ high, but it also may function adequately by showing two cards per side to four cards per side rather than three cards per side. Obviously, the size and height of the tube may vary according to the available area on which the display apparatus is used.

In the preferred embodiment of the apparatus, individual business cards are used. One may use, however, other suitable advertising means, such as a single card of a size adapted to fit onto the entire area of one side of the support member.

The apparatus is reusable, lightweight, easily cleaned, simple in design and economical to manufacture.

The foregoing description and drawing merely explains and illustrates the invention and the invention is not limited thereto, except insofar as the independent claims are so limited is those who are skilled in the art and have the disclosure before them will be able to make modifications and variations therein without departing from the scope of the invention.

What is claimed is:

1. In combination:

a base;

a plurality of support members, removably mounted on said base, each support member facing in a different respective direction;

means for mounting at least one advertisement on each of said support members;

means mounting said support members for movement relative to said base to change the direction in which a given advertisement faces;

a hollow, transparent tube having a plurality of walls and constituting transparent cover means for enclosing and protectively covering said support members;

each support member and its respective advertisement facing a respective wall on said transparent tube;

said support members, when attached together, form a resilient, strip-like member having a first outer edge and a second outer edge; and, said resilient, strip-like member is located within said tube and is resiliently deformable between an expanded, open first condition and a second condition in which said first edge and said second edge are substantially adjacent to each other and said strip-like member is at least partially closed for urging the advertisement toward its respective wall on the transparent tube.

2. A combination as recited in claim 1, and further comprising:

means on said base for holding condiments.

3. A combination as recited in claim 2, wherein said condiment holding means comprises:

a plurality of condiment holding sections separated from each other by said tube.

4. A combination as recited in claim 1 and further comprising:

means removably mounting said cover means relative to said support members.

5. A combination as recited in claim 1 wherein said resilient strip-like member comprises:

a plurality of panels each hingedly connected to at least one of other panel, there being a panel for each wall on said transparent tube.

6. A combination as recited in claim 5, wherein:

said plurality of panels comprises at least one inside panel and a pair of end panels, each end panel having an unconnected outer edge and an inner edge connected to an inside panel.

7. A combination as recited in claim 6, wherein:;

said resilient strip-like member conforms substantially to the shape of said hollow tube when the strip-like member is in its second condition.

8. In the combination as recited in claim 5, wherein each panel comprises:

a plurality of display sections, each section comprising means for displaying an advertisement facing in the same direction.

9. A combination as recited in claim 5, wherein each panel comprises:

at least one display section comprising means for displaying an advertisement.

10. A combination as recited in claim 5, wherein each panel comprises:

means for removably mounting said advertisements.

11. A combination as recited in claim 5, wherein:

each panel is vertically disposed and faces in a different respective direction;

means on each of said panels for mounting a plurality of advertisements, one above the other; and, a vertically disposed, transparent cover means for protectively covering the advertisements on all of said plurality of panels.

12. A combination as recited in claim 11:

said cover means comprises a tube having a rectangular horizontal cross-section;

said plurality of panels are disposed on the inside of said tube, there being one panel facing each of the four walls of said tube;

said mounting means for the advertisements comprises means for mounting said advertisements between a respective panel and the corresponding tube wall toward which said panel faces; and, said strip-like member normally urging each of said panels toward its correspondent tube wall.

13. A combination as recited in claim 1, wherein:

said transparent cover means is a single integral member.

14. A combination as recited in claim 1, wherein said cover means and said strip-like member are movable relative to the other.

* * * * *